US006569310B2

(12) United States Patent
Bandlish et al.

(10) Patent No.: US 6,569,310 B2
(45) Date of Patent: May 27, 2003

(54) ELECTROCHEMICAL PROCESS FOR PREPARATION OF ZINC POWDER

(75) Inventors: Baldev K. Bandlish, Charlotte, NC (US); Vincent Wise Martin, Gastonia, NC (US)

(73) Assignee: Clariant Finance (BVI) Limited, Tortola (VG)

( * ) Notice: Subject to any disclaimer, the term of this patent is extended or adjusted under 35 U.S.C. 154(b) by 56 days.

(21) Appl. No.: 09/776,518

(22) Filed: Feb. 2, 2001

(65) Prior Publication Data

US 2002/0134688 A1 Sep. 26, 2002

(51) Int. Cl.[7] ..... C25C 1/16
(52) U.S. Cl. ..... 205/604; 205/603
(58) Field of Search ..... 205/602, 603, 205/74, 604

(56) References Cited

U.S. PATENT DOCUMENTS

| | | | | | |
|---|---|---|---|---|---|
| 3,326,783 | A | * | 6/1967 | Winter | 205/604 |
| 3,860,509 | A | * | 1/1975 | Emmett, Jr. | 204/216 |
| 4,073,709 | A | * | 2/1978 | Pittie et al. | 204/113 |
| 4,115,210 | A | * | 9/1978 | Dekeister et al. | 205/74 |
| 4,139,429 | A | * | 2/1979 | Steward et al. | 204/237 |
| 4,234,401 | A | * | 11/1980 | Brannan | 205/101 |
| 4,272,333 | A | * | 6/1981 | Scott et al. | 204/222 |
| 4,431,496 | A | * | 2/1984 | Remick | 205/602 |
| 4,627,899 | A | * | 12/1986 | Smith et al. | 205/371 |
| 5,635,051 | A | * | 6/1997 | Salas-Morales et al. | 205/560 |
| 5,720,867 | A | * | 2/1998 | Anastasijevic et al. | 204/237 |
| 5,958,210 | A | | 9/1999 | Siu et al. | 205/602 |

FOREIGN PATENT DOCUMENTS

| | | |
|---|---|---|
| DE | 506590 | 8/1930 |
| DE | 581013 | 6/1933 |
| DE | 653557 | 11/1937 |

OTHER PUBLICATIONS

Jean St–Pierre & Dominique L. Piron, "Electrowinning of zinc from alkaline solutions"; Chapman and Hall Ltd., 1986, pp 447–456, No month given.

Neelakanthie Ekanayake Gunawardena & Derek Pletcher, Acta Chemica Scandinavica B37 (1983) No. 6, "A High Current Density Electrosynthesis Of Amines From Nitro Compounds Using Metal Powders As Intermediates", p549–553, No month given.

Hungarian Journal of Industrial Chemistry Veszprem, vol. 13, (1985) "Electrochemical Regeneration of Zinc Powder", p287–299, No month given.

J. St–Pierre & D.L. Piron, Journal of Applied Electrochemistry 20 (1990)—Short Communication, "Electrowinning of zinc from alkaline solutions at high current densities" p63–65, No month given.

Neelakanthie Ekanayake Gunawardena and Dereck Pletcher, A High Current Density Electrosynthesis of Amines form Nitro Compounds Using Metal Powders as Intermediates, Acta Chemica Scandinavica, B37, No. 6, 1983, No month given.

Orszagh and B. Vass, Electrochemical Regeneration of Zinc Powder, Hung. J. Ind. Chem., vol. 13, 1985, pp 287–299–456, No month given.

J. St–Pierre, D.L. Piron, Elecetrowinning of Zinc from Alkaline Solutions at High Current Densities, J. App. Electrochem., 20(1), p. 163–5, 1990, No month given.

J. St–Pierre, Dominique L. Piron, Electrowinning of Zinc from Alkaline Solutions, Chapman and Hall Ltd., 1986, pp 447, No month given.

D. Pletcher and F.C. Walsh, Industrial Chemistry, p. 245–6, Blackie Academic, 1993, No month given.

* cited by examiner

*Primary Examiner*—Nam Nguyen
*Assistant Examiner*—Thomas H. Parsons
(74) *Attorney, Agent, or Firm*—Krishna Banerjee; Richard P. Silverman

(57) ABSTRACT

Disclosed is an electrochemical process for preparing zinc powder which involves: a) providing to an electrochemical cell a basic solution of zinc oxide or any other zinc compound that reacts with an aqueous base to produce zinc oxide, the basic solution prepared by dissolving the zinc oxide or the other zinc compound in an aqueous 2.5 to 10.0 M base solution; and b) passing current to the cell at a current density of about 10,000 to about 40,000 A/m$^2$ for a time period sufficient to electrochemically reduce the zinc oxide to zinc powder, wherein the electrochemical process has a current efficiency of at least 70% and is substantially free from electrode corrosion.

20 Claims, No Drawings

ELECTROCHEMICAL PROCESS FOR PREPARATION OF ZINC POWDER

BACKGROUND OF THE INVENTION

1. Field of the Invention

The present invention provides an electrochemical process for the preparation of zinc powder from zinc oxide.

2. Description of the Related Art

Zinc powder is widely used in the chemical industry in various industries. Zinc oxide containing other zinc salts, metal impurities, etc. is produced as a byproduct. Recycling of the zinc oxide to produce pure zinc powder is highly desirable from a cost as well as an environmental point of view.

The electrodeposition of zinc metal is a well-known reaction in electrochemical technology (See, for example, D. Pletcher and F. C. Walsh, *Industrial Electrochemistry*, Blackie Academic, 1993). The electrogalvanizing of steel is a process carried out on a very large scale and aqueous acid is the normal medium. High speed, reel to reel galvanizing of steel is carried out in sulfuric acid with dimensionally stable anodes and uniform deposition is achieved at high current density by inducing very efficient mass transport by rapid movement of the steel surface. The deposition of zinc metal is also the critical electrode reaction in the electrowinning and electrorefining of zinc. In addition, there are a number of technologies, which have been demonstrated for the removal of Zn(II) from effluents. However, in these technologies, concentration of Zn(II) is low, commonly less than 100 ppm. Finally, the deposition of zinc has been widely investigated as the cathodic reaction in candidate secondary batteries. In all these applications, however, the objective is to select the conditions so as to give an adhesive and smooth zinc coating.

Zinc powder can be produced by electrolysis either in strong alkaline or neutral zinc containing solutions. The first patents obtained on the alkaline electrolysis process date back to the early thirties (German Patents, 581013, 506590, 653557). In these methods, a low current density of 1200–1500 amperes/sq. meter ($A/m^2$) was used. Volume efficiency and current density of these batch type processes are too low to be industrially attractive. I. Orszagh and B. Vass (Hung. J. Ind. Chem., 13,(1985) 287) used these methods to recycle zinc oxide byproduct from zinc dithionite production. They, however, used a divided cell, and lower current densities, which is significantly more capital intensive than using an undivided cell. In their study, at lower current densities no significant difference was observed at different sodium hydroxide concentrations.

For the recycling of zinc oxide containing waste by an alkaline electrolysis process to be industrially attractive, alkaline electrolysis process needs to be improved to lower capital as well as operational expenses. Capital expenses can be significantly reduced by increasing the current density and by providing a process that is capable of being carried out in an undivided cell. Furthermore, electrolysis conditions need to be improved to achieve high volume efficiency and minimum corrosion of the electrodes. The present invention unexpectedly fulfills these and other needs.

J. St-Pierre, D. L. Piron (Electrowinning of zinc from alkaline solutions at high current densities; *J. Appl. Electrochem* (1990), 20(1), 163–5), discloses experimental results conducted at high current density (2000 to 8000 $A/m^2$) to obtain cell voltage and current efficiency data necessary for specific energy computations.

U.S. Pat. No. 5,958,210 discloses a method for electrowinning metallic zinc from zinc ion in aqueous solution, said method comprising performing electrolysis on a mixture of solid conductive particles and aqueous alkali solution, said solution ranging in concentration from about 3N to about 20N alkali and containing dissolved zinc ion at an initial concentration ranging from about 50 to about 500 grams of zinc ion per liter of said solution, in an electrolytic cell containing first and second vertically arranged, parallel flat plates defined as a current feeder and a counter electrode, respectively, said counter electrode coated with a substance that is catalytic for oxygen evolution, said cell further containing an ion-permeable diaphragm parallel to each of said plates and interposed therebetween to define a gap between said current feeder and said diaphragm, by passing said mixture of particles and solution through said gap such that said particles contact said current feeder and passing a current across said gap, thereby depositing metallic zinc from said solution onto said particles. The elelctrowinning process is disclosed to yield high current efficiency and low energy consumption. The process, however, is not industrially attractive for a large-scale production of zinc powder because it uses a relatively more complex cell, and a lower current density.

SUMMARY OF THE INVENTION

The present invention provides an electrochemical process for preparing zinc powder which comprises the steps of:

a) providing to an electrochemical cell a basic solution of zinc oxide or any other zinc compound that reacts with an aqueous base to produce zinc oxide, the basic solution prepared by dissolving the zinc oxide or the other zinc compound in an aqueous 2.5 to 10.0 Molar (M) base solution; and b) passing current to the cell at a current density of about 10,000 to about 40,000 Amperes/meter$^2$ ($A/m^2$) for a time period sufficient to electrochemically reduce the zinc oxide to zinc powder, wherein the electrochemical process has a current efficiency of at least 70% and is substantially free from electrode corrosion.

DESCRIPTION OF THE PREFERRED EMBODIMENTS

The first step a) of the presently claimed electrochemical process for preparing zinc powder involves: providing to an electrochemical cell a basic solution of zinc oxide or any other zinc compound that reacts with an aqueous base to produce zinc oxide, the basic solution prepared by dissolving zinc oxide or the other zinc compound in an aqueous 2.5 to 10.0 M base solution.

As used herein, the phrase "zinc powder" encompasses zinc metal particles of various particle sizes known to one of ordinary skill in the art and is not limited to fine particles.

The electrolytic cell employed in the present invention may be an undivided or divided cell, with the undivided cell being preferred. Use of an undivided cell requires lower capital. Furthermore, operational costs are also lower when an undivided cell is used. Therefore, it is important that the process be capable of being carried out in an undivided cell, if desired.

Since zinc powder formed at the cathode by the reduction reaction can react with the oxygen generated at the anode, cathodic and anodic chemistries are generally separated by some kind of a porous diaphragm which allows the current to pass, but suppresses mixing of anolyte and catholyte. Cells of this kind are called divided cells.

The design of the undivided cell is simpler and the cell voltage required to achieve the desired current density is lower because of the lower ohmic resistance. This means that the electrical cost is generally lower where an undivided cell is used. Furthermore, capital cost required with the undivided cell is significantly lower than the divided cell.

The anode may be made from any conventional suitable material such as platinum, or iridium, either of which may be coated over an inert support such as niobium or titanium. The anode may also be made of nickel, or from conventional materials having good alkali corrosion resistance, e.g., lead or stainless steel. The cathode may be made from any conventional suitable materials having good alkali corrosion resistance, such as magnesium, magnesium alloy, nickel, lead and stainless steel. Preferably, the anode in the present invention is formed of stainless steel, and the cathode is formed of stainless steel, magnesium, or magnesium alloy.

The basic solution of zinc oxide is prepared by dissolving zinc oxide, or the other zinc compound (such as zinc sulfate) in an aqueous 2.5 to 10.0 M base solution, preferably 2.5 to 8.0 M base solution, and in one embodiment 2.5 M to 5.0 M, and in one embodiment 5.0 to 10.0 M, and in one embodiment 8.0 to 10.0 M base solution.

Concentration of the aqueous base solution (such as caustic solution) should be as high as possible because of the higher solubility of zinc oxide in more concentrated aqueous base solutions. In order to achieve high current density (which is a function of the concentration of the electroactive species such as zinc ions), high current efficiency, and high volume efficiency (i.e., high amount of zinc produced per volume unit of electrolyte) it is desirable to use the electrolytes containing high concentration of zinc ions. Because of the higher solubility of zinc oxide in stronger base solutions, it is desirable to use stronger base solutions. Furthermore, higher concentration of base solutions should be desirable for minimizing corrosion of the anode. However, it has been unexpectedly found that too high concentration (such as concentration substantially higher than 10 M) of base (e.g., NaOH solution) solution is not desirable because of its unexpected adverse effect on corrosion of the stainless steel anode and on the current efficiency of the process where electrolysis is carried out at high current densities (such as higher than 10,000 $A/m^2$). This adverse effect is minimized by lowering the aqueous base concentration. The most preferred concentration of the aqueous base is 5.0 to 8.0 M.

The aqueous base solutions employed in the process of the invention are prepared by combining water with a source of alkali metal or alkaline earth metal ions, such as lithium, sodium, and potassium, and a source of hydroxyl ($OH^-$ ions). A single source may of course provide both types of ions. The various alkali or alkaline earth metal ions are preferably supplied from various compounds such as hydroxides and oxides. Preferred base solutions are sodium and potassium hydroxide solutions.

The solubility of zinc oxide in the aqueous base solution is limited, and depends on the temperature. The present invention envisions use of the zinc oxide at any range of concentrations in which it is soluble in the aqueous base solution. However, the concentration of the electroactive species—in this case zinc ions—is a major variable that determines the maximum feasible current density at which zinc is electrodeposited at maximum current efficiency. An excessive current density will generally lead to secondary reactions such as hydrogen evolution (with a potential for some safety problems). Thus, too low a concentration of zinc ions in the electrolyte at high current densities will lead to lower current efficiency and hence is undesirable from cost and safety considerations. In one preferred embodiment, the zinc oxide or the other zinc compound which produces the zinc oxide is present in the basic solution in an amount of 1 to 9 wt. % at 90° C., and in one more preferred embodiment from 1 to 6 wt. % at 90° C., based on the weight of the basic solution. Electrolysis of the basic zinc solutions containing approximately 1% zinc ions at a current density as high as 20,000 $A/m^2$ produce zinc at a current efficiency of 75 to 85%. Electrolysis of solutions containing less than 1% zinc ions is also not attractive from volume efficiency considerations.

The second step b) of the presently claimed invention involves passing current to the cell at a current density of 10,000 to 40,000 $A/m^2$, and in one embodiment from 10,000 to 15,000 Amps per square meter ($A/m^2$), and in one embodiment, from 15,000 to 20,000 $A/m^2$, and in one embodiment from 20,000 to 30,000 $A/m^2$ and in one embodiment from 30,000 to 40,000 $A/m^2$, for a time period sufficient to electrochemically reduce the zinc oxide to zinc powder, wherein the electrochemical process has a current efficiency of at least 70%, and in one embodiment at least 80%.

As used herein, the phrase "current efficiency" is the ratio, generally expressed as a percentage, of the actual zinc deposition rate to the rate which would be achieved if all of the current passing through the cell were consumed by reduction of zinc ion. The current efficiencies in zinc electrowinning cells are typically less than 100% because of the concurrent reduction of hydrogen ion (from water) to hydrogen gas, competing with the reduction of $Zn^{2+}$ (e.g., from zinc oxide) to zinc metal at the cathode.

For electrolysis, temperatures higher than ambient are generally desired because of the beneficial effects on the kinetics of all steps in an electrode process. At higher temperatures, the diffusion coefficient, the exchange current density and the rates of chemical reactions generally are increased. The decrease in viscosity and increase in diffusion coefficient leads to the increased mass transport rates. This increased mass transport of zinc ions from the bulk of the solution to the cathodic region is highly desirable. However, increase in the rate of chemical reaction such as the oxidation of zinc produced with oxygen and mass transport of the byproduct oxygen to the bulk of the solution may not be desirable. In the present invention, higher than ambient temperatures are found to be favorable for the electrolytic reduction of zinc oxide to zinc, and are preferred.

Thus, in one embodiment, the presently claimed electrochemical reduction process is conducted at a temperature of from 30° C. to 105° C., preferably from 70° to 100° C., and more preferably from 80° to 95° C.

The electrochemical process of the present invention is substantially free of electrode corrosion. As used herein, the phrase "substantially free of electrode corrosion" encompasses corrosion levels, expressed as milligrams of electrode metal lost to corrosion/mole of electrons passed of 100 or less (i.e. $\leqq$100 mg/mole of electrons). In one embodiment, the corrosion levels are less than or equal to 50 mg/mole of electrons, and in one embodiment less than or equal to 40, 30, 20, 10, and 5 mg/mole of electrons. Methods for measuring corrosion levels will be known to one of ordinary skill in the art. In one embodiment, as in the present invention, it is measured by analysis of the recovered zinc powder for iron ion concentration by atomic absorption spectroscopy or inductively coupled plasma, as iron ions (from corroded stainless steel) are insoluble in the aqueous base solutions of the present invention.

The following specific examples will provide detailed illustrations of the methods of producing and utilizing compositions of the present invention. These examples are not intended, however, to limit or restrict the scope of the invention in any way and should not be construed as providing conditions, parameters or values which must be utilized exclusively in order to practice the present invention. Unless otherwise specified, all parts and percents are by weight.

EXAMPLES

Example 1

General Procedure 1 or 2 is used for Electrolytic Reduction of Zinc Oxide to Zinc Powder.

General Procedure 1:

In these experiments, a 4 L resin Kettle (4 inch in diameter and 18 inch high) is used as the cell. A solution of zinc oxide in the aqueous sodium hydroxide solution (3 to 3.5 liters) at 50 to 80° C. is charged into the resin kettle. A thermometer, stainless steel cathodes and anodes are positioned in the cell using laboratory clamps. Mixing is achieved by pumping (a centrifugal pump (March #BC-3C-MD) is used) the solution of ZnO from the bulk of the solution to the region between cathodic and anodic plates. Parts of the cathode and anode surfaces are covered with Teflon tape to achieve the desired active cathode and anode surface areas. Electrolysis is carried out at various current densities and the number of coulombs passed is measured by using a digital coulometer. A portion of the zinc deposited on the cathode is removed periodically. At the end of the experiment, zinc particles are separated from the electrolyte by decantation, washed with water and then dried. Dried zinc particles were analyzed to determine the zinc content.

General Procedure 2:

Same as general procedure 1, except that mechanical stirring (rather than pumping of solution) is used to mix the ingredients in the electrochemical cell.

Example 2

The results of electrolysis of zinc oxide under various conditions using general procedure 1 or 2 are shown below in Table 1.

TABLE 1[1]

| Exp. No. | [NaOH][2] (M) | Initial # moles of zinc ions in electrolyte | Moles of electrons passed | Temp. (° C.) | Current Density ($A/m^2$) | Zn produced (moles) | Current Efficiency (%) | Anode Corrosion (mg lost/mole electrons) | General Procedure |
|---|---|---|---|---|---|---|---|---|---|
| 1 | 8.0 | 3.7 | 2.50 | 52–75 | 19375 | 0.93 | 75 | 34 | 1 |
| 2 | 19.0 | 4.6 | 2.50 | 80–81 | 19375 | 0.17 | 14 | 1076 | 1 |
| 3 | 4.0 | 1.0 | 1.76 | 63–66 | 21053 | 0.67 | 76 | 6 | 1 |
| 4 | 4.0 | 1.1 | 1.87 | 74–78 | 19375 | 0.80 | 86 | 1 | 1 |
| 5 | 4.0 | 1.0 | 1.76 | 57–62 | 20202 | 0.75 | 86 | 3 | 2 |
| 6 | 4.0 | 1.0 | 1.77 | 79–90 | 29206 | 0.73 | 83 | 1 | 2 |
| 7 | 8.0 | 2.6 | 4.65 | 79–80 | 10159 | 2.02 | 87 | 10 | 2 |
| 8 | 2.8 | 0.43 | 0.73 | 55–67 | 10159 | 0.13 | 34 | 1 | 2 |
| 9 | 19.0 | 5.17 | 3.10 | 74–75 | 1491 | 1.13 | 72 | 173 | 2 |

[1]In all these experiment, stainless steel (316 stainless steel) electrodes (anode and cathode) are used. Inter electrode distance is 2 cm.
[2]Concentration of NaOH before ZnO is dissolved in it.

In the above experiments (Table 1), in general, when mass transport is achieved by pumping (general procedure 1) the electrolyte solution from the bulk to the cathodic region, a lower current efficiency is observed than when mechanical stirring is used for mass transport (compare Expt. 3 versus Expt. 5, Table 1). While not wishing to be bound by theory, it is believed that this is caused by the greater mixing of the zinc produced at the cathode with the oxygen produced at the anode caused by the centrifugal pump compared to mixing by mechanical stirring.

The unexpected results of the present invention can be understood from the following discussion. Electrochemical recycling of zinc oxide byproduct to zinc powder suffers from its poor solubility in base solution. Solubility increases with increased base solution. One way to increase zinc ion concentration is to increase the concentration of the base solution. Furthermore, a greater concentration of zinc ions is expected to improve mass transport of zinc ions to the cathode and hence the current efficiency of the electrodeposition of zinc. The Applicants have surprisingly found that electrolysis of a solution with increased concentration of zinc based salt, where a 19 M base solution is used to dissolve zinc oxide to achieve a higher concentration of zinc based salts, results in poorer current efficiency when a current density of 19375 $A/m^2$ is used. (See Expt. No. 2 vs. Expt. No. 1, Table 1). Such a result is surprising in view of the prior art (See, e.g., I. Orszagh and B. Vass, Hung. *J. Ind. Chem.,* 13, (1985) 287 and U.S. Pat. No. 5,958,210). In view of such an unexpected finding, Applicants have found a range of base concentrations (2.5 M to 10.0 M), wherein the electrochemical process can be carried out at high current densities (10,000 to 40,000 $A/m^2$) and current efficiencies (70–100%).

Use of stainless steel anode under alkaline conditions is not expected to result in corrosion of the anode. Corrosion generally takes place if protons generated at the anode are not neutralized. High base (e.g., NaOH) concentration is expected to neutralize these protons more efficiently and hence corrosion under high base concentration should be even lower than under lower base concentration. However, the data in Table 1 surprisingly shows that corrosion with a 19 M caustic solution (Exp. No. 2) is dramatically more than corrosion with an 8 M (Exp. No. 1) caustic solution.

Each of the documents referred to above is incorporated herein by reference in its entirety, for all purposes. Except in the Examples, or where otherwise explicitly indicated, all numerical quantities in this description specifying amounts and concentrations of materials, reaction and process conditions (such as temperature, current density, current efficiency), and the like are to be understood to be modified by the word "about".

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An electrochemical process for preparing zinc powder which comprises the steps of:

a) providing to an electrochemical cell a basic solution of zinc oxide or any other zinc compound that reacts with an aqueous base to produce zinc oxide, the basic solution prepared by dissolving the zinc oxide or the other zinc compound in an aqueous 4.0 to 10.0 M base solution; and b) passing current to the cell at a current density of about 10,000 to about 40,000 $A/m^2$ for a time period sufficient to electrochemically reduce the zinc oxide to zinc powder, wherein the electrochemical process has a current efficiency of at least 70% and is substantially free from electrode corrosion.

2. The process of claim 1, wherein the electrochemical cell comprises stainless steel electrodes.

3. The process of claim 1, wherein the electrochemical cell has a magnesium or magnesium alloy cathode.

4. The process of claim 1, wherein the aqueous base comprises ions of at least one alkali or alkaline earth metal and hydroxyl ($OH^-$) ions.

5. The process of claim 4, wherein the alkali or alkaline earth metal ion is selected from the group consisting of sodium, potassium, and mixtures thereof and is provided in the form of a compound selected from the group consisting of hydroxides, and oxides.

6. The process of claim 5, wherein the aqueous base is selected from sodium hydroxide and potassium hydroxide.

7. The process of claim 6, wherein the aqueous base is sodium hydroxide.

8. The process of claim 1, wherein in step a), the zinc oxide or the other zinc compound is present in the basic solution in an amount of about 1 to 9 wt. % calculated at 90° C., based on the weight of the basic solution.

9. The process of claim 1, wherein in step a), the zinc oxide or the other zinc compound is present in the basic solution in an amount of about 1 to 6 wt. % calculated at 90° C., based on the weight of the basic solution.

10. The process of claim 1, wherein step b) is carried out at a temperature range of from about 30 to about 105° C.

11. The process of claim 1, wherein step b) is carried out at a temperature range of from about 80 to about 95° C.

12. The process of claim 1, wherein the electrochemical process has a current efficiency of at least 80%.

13. The process of claim 1, wherein the electrode corrosion is corrosion of the anode and Is less than or equal to 100 milligrams of lost electrode metal/mole of electrons.

14. The process of claim 1, wherein the electrode corrosion is corrosion of the anode and is less than or equal to 50 milligrams of lost electrode metal/mole of electrons.

15. The process of claim 1, wherein the electrode corrosion is corrosion of the anode and is less than or equal to 5 milligrams of lost electrode metal/mole of electrons.

16. The process of claim 1 wherein the basic solution has a concentration of from 4.0 to 8.0 M.

17. The process of claim 1, wherein in step a), the base solution has a concentration of about 5.0 M to about 8.0 M.

18. The process of claim 1, wherein the in step b), the current density is in the range of about 10,000 to about 30,000 $A/m^2$.

19. The process of claim 1, wherein the electrochemical cell is an undivided cell.

20. The process of claim 1, wherein the other zinc compound is zinc sulfate.

* * * * *